United States Patent [19]

Feagin

Best Available Copy

[11] 4,216,815

[45] Aug. 12, 1980

[54] METHOD OF MAKING A CERAMIC SHELL MOLD

[76] Inventor: Roy C. Feagin, Boca Raton, Fla.

[21] Appl. No.: 921,832

[22] Filed: Jul. 3, 1978

[51] Int. Cl.³ ..... B22C 1/18; B22C 9/04

[52] U.S. Cl. ..... 164/26; 106/38.3; 106/38.9; 164/41; 164/361

[58] Field of Search ..... 164/25, 26, 41, 42, 164/361; 106/38.2, 38.22, 38.3, 38.9

[56] References Cited

U.S. PATENT DOCUMENTS

| | | | |
|---|---|---|---|
| 3,722,577 | 3/1973 | Webb | 164/25 X |
| 3,752,689 | 8/1973 | Moore, Jr. | 164/26 |
| 3,859,153 | 1/1975 | Beyer et al. | 164/26 |
| 3,894,572 | 7/1975 | Moore, Jr. | 164/26 |
| 3,933,190 | 1/1976 | Fassler et al. | 164/26 |
| 3,935,023 | 1/1976 | Derolf | 106/308 B |

*Primary Examiner*—Robert D. Baldwin
*Assistant Examiner*—J. Reed Batten, Jr.
*Attorney, Agent, or Firm*—Wenderoth, Lind & Ponack

[57] ABSTRACT

Method for making a novel shell mold for use in directional solidification and for casting alloys containing reacting components, wherein a binder comprising a non-fibrous aqueous acidic dispersion of alumina monohydrate and being essentially free of silica, is employed. The resultant shell mold is particularly suitable for the casting of nickel and cobalt based alloys containing relatively reactive constituents such as zirconium, aluminum and titanium.

12 Claims, No Drawings

METHOD OF MAKING A CERAMIC SHELL MOLD

BACKGROUND OF THE INVENTION

This invention relates to the manufacture of refractory coatings and in particular, shell molds for use in directional solidification and for casting alloys containing reactive components.

The predominant process for making small and intricate castings such as turbine blades, vanes, nozzles and many other parts is the ceramic shell mold process. A group of expendable patterns of parts to be cast is made, for example, in wax, and set up into a cluster. This cluster is then dipped into a ceramic slurry, removed and coarse refractory is sprinkled on the wet slurry coating and allowed to harden or "set." This process is repeated several times until a sufficient thickness of ceramic is built up onto the wax pattern. Drying or chemical setting can be carried out on each layer. After the final thickness is reached, the entire assembly is "set" or dried. The wax is then removed by one of several acceptable techniques, such as in a steam autoclave or by actually firing the mold to melt out the wax. The mold is then preheated to an appropriate temperture and the metal is poured into the resulting mold.

Instead of wax, the expendable pattern may be formed of polystyrene, plastic modified wax, etc.

The usual refractories used in this system are fused silica, crystalline silica, aluminosilicates, zircon, and alumina.

Heretofore, bonding of these refractory particles has been mostly carried out by an alcoholic solution of hydrolyzed ethyl silicate or a colloidal dispersion of silica in water. Upon drying of the shell molds, the silica serves as a bond for the refractory particles. Typical ceramic shell mold processes are given in the following U.S. Pat. Nos. 3,165,799, 3,933,190, 3,005,244 and 3,955,616.

The deficiencies of silica-bonded shell molds are particularly apparent in the directional solidification technique of casting.

Such technique has been developed for producing castings having directionally solidified grains, which is particularly applicable to the manufacture of turbine blades wherein the blade has longitudinal grains, whereby the high temperature properties are improved as a result of the grain structure. One of the techniques used in producing such structures is described in the Ver Snyder U.S. Pat. No. 3,260,505. Because of the long slow cooling rates, the alloys poured, which many times contain some relatively reactive constituents, are left exposed to the hot mold for long periods of time. With silica bonds, such exposure causes a reaction with the bond by some alloys and produces a casting having a relatively poor surface and relatively poor high temperature properties.

Further when an alloy is poured into a ceramic mold, which is usually around 1800° F. in normal casting operations, the alloy almost immediately solidifies, or else it solidifies immediately adjacent to the mold, because of the wide discrepancy in temperature. This solidification means a crystal formation and accordingly the casting comes out as an equiaxed grain casting. In directional solidification, the technique is to start the crystal growth from the base of a blade; for example, to grow vertically or longitudinally to form a long crystal in the direction of the blade length for best results. The less the discrepancy between the metal temperature and the mold temperature, the greater are the probabilities of being able to do this. Ideally, a mold should be at at least the solidification point of the alloy or above, so that when the metal is poured in, it will not immediately solidify adjacent to the mold surface, but then the cooling can be controlled from any direction that it is desired to do so. Therefore, by having molds that can withstand higher than normal casting temperatures, more control on grain structure can be obtained. The general maximum service temperature for conventional molds is now about 2500° F. Anything above this leads to softening of the silica bonds now normally used and aggravates reactivity problems.

One attempt to overcome the reactivity problems with silica molds is described in U.S. Pat. No. 3,933,190 relating to the use of an aluminum polyoxychloride binder with an alumina refractory to form the mold. However, this type of binder has very poor green and elevated temperature strengths, thereby making it difficult to dewax the mold without cracking and destroying the mold surface. Likewise the aluminum polyoxychloride is soluble in steam, which does not permit the mold to be autoclave dewaxed.

Some observers have shown that alumina is relatively inert compared to silica with most nickel and cobalt based alloys containing minor quantities of reactive components and thus a satisfactory all-alumina shell is highly desirable.

A satisfactory all-alumina shell mold is described in Ser. No. 889,142 of the present inventor, filed Mar. 20, 1978, however, it employs a fibrous type colloidal alumina which is a rather expensive component.

OBJECTS AND BRIEF SUMMARY OF THE INVENTION

An object of this invention is to provide an improved high temperature refractory coating.

Another object is to provide an improved high temperature shell mold.

Another object is to provide a relatively inexpensive, essentially all-alumina final shell mold for use in producing directionally solidified castings.

Yet another object of this invention is to provide a non-reactive mold surface for alloys containing reactive components.

These and other objects are realized by the present invention wherein the binder for making the shell mold comprises a non-fibrous, aqueous, acidic dispersion of alumina monohydrate, the binder being essentially free of silica.

By use of the above binder, the resulting mold exhibits excellent green strength which facilitates dewaxing in an autoclave or by other means and yet is significantly less expensive than the fibrous alumina shell mold of Ser. No. 889,142.

The mold of the present invention also retains sufficient strength during the dewaxing operation to prevent cracking of the mold and has sufficient strength to permit preheating temperature up to about 3100° F., e.g. 2750° to 3100° F.

Further, by virtue of the fact that an all-alumina system is provided, alloys containing reactive components such as nickel and cobalt-based alloys containing one or more of hafnium, zirconium, tungsten, aluminum, titanium, niobium, molybdenum, carbon, silicon, manganese or yttrium, can be poured without adverse effects due to their reactivity.

DETAILED DESCRIPTION

The basic method for making the shell mold comprises making an expendable wax pattern of a part to be cast, dipping the expendable pattern into a slurry of a ceramic powder and a binder to form a moist coating on said wax pattern, sprinkling a coarse refractory powder on said moist coating, drying said moist coating, and repeating dipping, sprinkling and drying, whereby said shell mold is built up to a desired thickness.

The binder of the present invention employs an aqueous acidic dispersion of alumina monohydrate in water. The alumina has an essentially spheroidal particle shape, i.e. it is non-fibrous and has a boehmite structure primarily. Needless to say, the binder should be essentially free of silica to avoid the above-discussed reactivity problems.

Typical commercially available alpha-alumina monohydrates are those produced under the Tradename "Dispural" obtained from Philadelphia Quartz and "Catapal" obtained from Conoco. The following tabulations are typical data on the characteristics of these two products:

| Property | Dispural | Catapal |
|---|---|---|
| Alpha-alumina monohydrate | 90% | |
| Water | 9% | |
| Carbon as primary alcohol | .5% | .36 |
| $SiO_2$ | .008 | .088 |
| $Al_2O_3$ content | | 74.2 |
| Total ignition loss | | 25.8 |
| Surface area (BET) | 320 sq. meters/gm | 250 sq. meters/gm |
| Particle size by sieving less than 45 microns | 85% | 48% |
| Greater than 90 microns | | 9% |

Some of these materials are obtained from Ziegler reactions such as the use of triethyl aluminum to produce high-molecular-weight trialkyl aluminums which are oxidized to yield aluminum alkoxides. These are then hydrolyzed with water to yield alumina monohydrate. Varying trace amounts of acid, such as sulfuric, may also be present.

The above alumina dispersions exhibit a tendency to gel outside of their normal pH range. Therefore it is essential to maintain the pH within precisely controlled limits, i.e. 2.7 to 5.4 and preferably 3.6 to 4.4

Failure to control the pH within the above range creates serious problems if the alumina is to be used as a binder for shell molds because the refractories used contain small amounts of impurities such as alkalis, and this is particularly true with the commercial tabular alumina. The acidity of the alumina dispersion acts to neutralize this alkali in the fine flours used and therefore the pH of the dispersion remains in the stable range.

A variety of acids can be used in rendering the dispersion sufficiently acidic.

The preferred acids used are mineral acids, such as hydrochloric, sulfuric, and nitric but strong organic acids such as monochloroacetic acid can also be used.

A typical colloidal alumina sol that is relatively stable has been described in U.S. Pat. No. 3,935,023. Previous work with this binder when mixed with tabular alumina produced relatively unstable slurries which could be prepared and could be applied as coatings, but would eventually gel. These slurries would generally become unstable when the weight ratio of alumina refractory to binder was increased beyond 2. The slurries would become thicker and progressively more thixotropic and would eventually become like a gel upon increasing the refractory to binder ratio from 2 to 3.75.

This invention thus provides a means for producing slurries that are stable enough from a practical standpoint to prepare shell molds of excellent quality.

If the alumina monohydrate already contains adequate acidic material, it may be possible to disperse it in plain water and it can be stable enough to produce an adequate slurry with sufficient shelf life. The slurry can further be modified with acid if needed.

The drying and heating of the dispersion changes it from alpha-alumina monohydrate to alpha-alumina and then to gamma-alumina.

A variety of refractories can be used with the binder of this invention, depending upon the particular application.

Thus, for example, useful refractories include one or more of quartz, fused silica, monoclinic zirconia, stabilized electrically fused zirconia, mullite, aluminosilicates, calcined alumina, fused alumina, ceria or yttria.

Certain refractories, such as fused silica, do not require the use of as much acid as other refractories.

In the case of directionally solidified castings, alumina or a non-reactive refractory is best used. Typical examples of a suitable alumina refractory is fused alumina (Norton Grade 38), or tabular alumina (Alcoa Grade T-61). Stabilized zirconia having a very high softening temperature may also be used for high temperature mold structures. Yttria, also having a very low reactivity with reactive metals, may be desirable for mold surfaces bonded with the alumina sol.

The number of alumina sol bonded coats may also vary depending upon the needs of the particular application.

Ammonia treatments may or may not be used with this sol system for hardening. It is generally not necessary but can be used if desired. In this regard, the alumina sol treatment with ammonia vapors after each coat acts to further insolubilize the alumina dispersion. Exposure to ammonia vapors causes the dispersion to increase in pH, thereby bringing it out of the stable range and causes a preliminary set. It should be mentioned also that ammonia setting of the complete shell after dipping causes the entire shell to set and become water resistant. Prior to that, it is less water resistant than without ammonia.

For some applications, it may be desirable to apply only one or two coats of refractory bonded with alumina sol, and then back up the remaining coats with either a solid mold structure or additional shell structure containing a different bond, such as colloidal silica or hydrolyzed ethyl silicate.

For some of the more reactive alloys, all that is needed is for the casting mold surface to be free from reactive materials and therefore a single coating of an alumina sol-bonded alumina, ceria, yttria, or zirconia refractory mold, is thought to be adequate for most of the reactive alloys. This coating can then be backed up with either a solid mold structure or by another type of shell mold structure including those made with a different type of binder.

In effect, as long as there is a totally non-reactive surface, i.e. by utilization of the present invention, it can be backed up with any other kind of a mold system that will withstand the casting conditions and alloys containing reactive metals.

Various aspects of the present invention will now be illustrated with reference to the following Examples which are not to be taken as limitative.

EXAMPLE 1

In this Example and those following there is employed a slurry utilizing a sol of the type described in the above U.S. Pat. No. 3,935,023.

A dispersion of Dispural was prepared according to the teachings of U.S. Pat. No. 3,935,023 with 25% solids and having a density of 60° F. of 1.19. This sol serves as the basis of the binder in slurries 1, 2, 3 and 4, as described in Table I.

Table I

| Slurry Number | Binder % $Al_2O_3$ | Type Refractory | grams wt. Refractory | cc. volume Binder | Drops conc. HCl | Drops Wetting Agent Sterox NJ* |
|---|---|---|---|---|---|---|
| 1 | 20 | Calcined $Al_2O_3$ A-17** | 2200 | 600 | 100 | 10 |
| 2 | 20 | zircon flour | 1925 | 525 | 70 | 5 |
| 3 | 20 | Calcined $Al_2O_3$ A-17** | 1050 | 255 | 40 | |
| 4 | 20 | Fused Silica Flour | 1200 | 540 | 10 | |

*Available from Monsanto Corporation.
**Available from Alcoa Corporation.

These slurries were prepared to a viscosity of about 30 seconds measured by the #4 Zahn cup. The viscosity should be between 33 and 35 seconds. The first dip was applied to a test pattern composed of a rectangular sheet of wax. Immediately after dipping, a coarse fused alumina of a nominal 70 grain size was sprinkled over the wet pattern, This was then allowed to dry. The slurry in the meantime was reduced in viscosity by adding more of the alumina binder solution to a viscosity of about 15 seconds by #4 Zahn cup. At the end of the indicated drying time the pattern was redipped and sprinkled with the appropriate stucco grains. See Table II.

Table II

| Slurry Number | Stucco System Coatings 1 | 2 | 3 | 4 | 5 | 6 | 7 |
|---|---|---|---|---|---|---|---|
| 1 | 70 grain Alundum | 70 grain Alundum | −28+ Tabular | 48 mesh Alumina | −14+ Tabular | 28 mesh Alumina | none |
| 2 | 70 grain Alundum | 70 grain Alundum | −28+ Tabular | 48 mesh Alumina | −14+ Tabular | 28 mesh Alumina | none |
| 3 | 70 grain Alundum | 70 grain Alundum | −28+ Tabular | 48 mesh Alumina | −14+ Tabular | 28 mesh Alumina | none |
| 4 | ←approx. −50 + 100 mesh | | | | ←−20 + 50 mesh → | | |
| | ←Fused Silica → | | | | ←Fused Silica → | | |

It was dried and this process continued until the seventh coat was applied, which did not receive a coarse refractory stucco. The final dipped pattern was then allowed to thoroughly dry at room temperature. Then, for melting out the wax, a low temperature oven at about 110° C. was employed.

The dipping times are summarized in Table III.

Table III

| Slurry Number | Dipping Times 1 | 2 | 3 | 4 | 5 | 6 | 7 |
|---|---|---|---|---|---|---|---|
| 1 | 1st day | 2nd day | 2nd day | 3rd day | 3rd day | 3rd day | 5th day |
| 2 | 1st day | 3rd day | 3rd day | 4th day | 4th day | 5th day | 5th day |
| 3 | 1st day | " | " | " | " | " | " |
| 4 | 1st day | " | " | " | " | " | " |

The flat shell specimens on each side of the wax sheet were then cut into test specimens by means of a diamond saw to about 1" width by 2½" length. These were tested on a transverse loading machine for breaking strength. Several specimens were broken to give an average value for room temperature modulus at rupture. Additional specimens were then fired to varying temperatures in a high temperature furnace according to a fairly rapid cycle within three hours, soaked at the maximum temperature for one hour, and then cooled in the furnace to room temperature. The specimens were then tested at room temperture for breaking strength. Values for each shell system are reported in Table IV.

Table IV

| Slurry Number | Modulus at Rupture* lbs./sq.in Non-fired | Fired 1200° F. | 1800° F. | 2000° F. | 2500° F. |
|---|---|---|---|---|---|
| 1 | 1041 | | 772 | | 2457 |
| 2 | 1049 | 978 | 1153 | 1365 | 3203 |
| 3 | 1100 | 789 | 1286 | 1438 | 3155 |
| 4 | 918 | 439 | 349 | 350 | 968 |

*Fired to indicated temperature and cooled to room temperature and tested.

The basic principle of obtaining a satisfactory slurry with a ratio of refractory to binder liquid of higher than 2 to 1 is to carefully and methodically add acid to the slurry.

Many times this can be done initially to a binder before adding refractory, but other times alternating acid and refractory additions are necessary. This appears to be related particularly to alumina refractory and one having considerable fines. By careful additions of acid with suitable stirring a slurry can be prepared of a satisfactory viscosity without gelling and having a ratio of refractory to binder of more than 2 to 1.

EXAMPLE 2

Two samples of a relatively acidic Dispural A and B (boehmite powders) were also used in preparing a sol. In view of their acidic nature, which probably was due to retained acid when it was removed from the original chemical reaction, they were used as binders. These were added to water and slurried along with the refractory to prepare slurries 5 and 6. The following Table V gives the slurry compositions.

Table V

| Slurry Number | Type Binder | Type Refractory | wt. grams Refractory | Weight Dispural |
|---|---|---|---|---|
| | Slurry Compositions | | | |
| 5 | Dispural A | A-17 Calcined $Al_2O_3$ | 1300 | 75 |
| 6 | Dispural B | A-17 Calcined $Al_2O_3$ | 1300 | 75 |

The stucco coatings are described in the following Table VI.

Table VI

| Slurry Number | 1 | 2 | 3 | 4 | 5 | 6 | 7 |
|---|---|---|---|---|---|---|---|
| | Stucco System Coatings | | | | | | |
| 5 | % M. Alundum | % M. Alundum | −28 + 48 Tabular | mesh Alumina | −14 + 28 Tabular | mesh $Al_2O_3$ | None |
| 6 | % M. Alundum | % M. Alundum | −28 + 48 Tabular | mesh Alumina | −14 + 28 Tabular | mesh $Al_2O_3$ | " |

These slurries were prepared in the same fashion as Example 1 and the modulus at rupture values are set forth in Table VII.

Table VII

| Slurry Number | Non-fired | 1200° F. | 1800° F. | 2000° F. | 2500° F. |
|---|---|---|---|---|---|
| | Modulus at Rupture* lbs./sq.in | | | | |
| | | Fired | | | |
| 5 | 880 | 813 | 1076 | 1171 | 2296 |
| 6 | 630 | 399 | 415 | 519 | 554 |

*Fired to the indicated temperature and cooled to room temperature and tested.

The following Tables VIII and IX disclose analytical information relative to Dispural A and B.

Table VIII

| Physical-Chemical Data of Selected Aluminas | Dispural A | Dispural B |
|---|---|---|
| Loss on drying, wt. % | 13.77 | 13.62 |
| $Al_2O_3$, wt. % | 68.69 | 69.09 |
| $SiO_2$, wt. % | 0.015 | 0.028 |
| $Fe_2O_3$, wt. % | <0.01 | <0.01 |
| $Na_2O$, wt. % | <0.01 | <0.01 |
| Carbon, wt. % | 0.13 | 0.15 |
| $TiO_2$, wt. % | 0.116 | 0.116 |
| Particle size, $\mu$ | 1.3 | 1.7 |
| Surface area, $m^2/g$ | 213 | 207 |

Table IX

| % Cl as HCl in Aqueous Dispersions of Dispural A and B | 10% Solids | 25% Solids | 27% Solids |
|---|---|---|---|
| Dispural A | 0.008 | 0.017 | 0.019 |
| Dispural B | 0.287 | 0.718* | 0 |

*Normalized to 25% analysis of 10% solids sample. At this level, gelling is avoided.

It is contemplated that the instant binder and refractory material bound thereby find a wide variety of applications other than in shell molds, for example, other types of molds and equipment which require durability at elevated temperature, especially where contact with reactive molten metal, e.g. at tempertures between 2000° to 3100° F. is involved.

I claim:

1. In a method for making a shell mold the steps of which consist essentially of:

a. making an expendable pattern of a part to be cast,
b. dipping the expendable pattern into a slurry of a refractory material and a binder to form a moist coating on said pattern,
c. sprinkling a coarse refractory powder on said moist coating,
d. drying said moist coating,
e. repeating steps (b), (c) and (d), whereby said shell mold is built up to a desired thickness,
f. removing the expendable pattern from said shell mold, and
g. firing the shell mold, the improvement wherein said binder comprises an aqueous, acidic, dispersion of an essentially non-fibrous alumina monohydrate, said binder being essentially free of silica, the acidity of said slurry being maintained at a level sufficient to prevent gelation.

2. The method according to claim 1 wherein the pH of said binder is about 2.7 to 5.4.

3. The method according to claim 1 wherein the pH of said binder is about 3.6 to 4.4.

4. The method according to claim 1 wherein the ratio of refractory to binder is more than 2 to 1 on a weight basis.

5. The method according to claim 1 wherein the refractory material comprises one or more of quartz, fused silica, monoclinic zirconia, stabilized electrically fused zirconia, mullite, aluminosilicates, calcined alumina, fused alumina, ceria or yttria.

6. The method according to claim 1 wherein the refractory material comprises one or more of alumina, ceria, zirconia or yttria.

7. The method according to claim 1 wherein the shell mold comprises two coats of refractory, each coat being bonded with said binder and said shell mold being supported by a solid mold structure.

8. The method according to claim 1 wherein the shell mold comprises one coat of refractory, said coat being bonded with said binder and said shell mold being supported by a solid mold structure.

9. The method according to claim 1 wherein the shell mold comprises one coat of refractory bonded with alumina being supported by an additional shell structure employing a different binder than said alumina.

10. The method according to claim 1 wherein the expendable pattern is a wax pattern.

11. The method of claim 1 wherein acid is added to said dispersion to maintain said dispersion within a range of pH sufficient to prevent gelation.

12. A green shell mold produced by the steps consisting essentially of:

a. making an expendable pattern of a part to be cast, b. dipping the expendable pattern into a slurry of a refractory material and a binder to form a moist coating on said pattern, c. sprinkling a coarse refractory powder on said moist coating, d. drying said moist coating, e. repeating steps b, c and d, whereby said shell mold is built up to a desired thickness, and f. removing the expendable pattern from said shell mold, the improvement wherein said binder comprises an aqueous, acidic, dispersion of an essentially non-fibrous alumina monohydrate, said binder being essentially free of silica, the acidity of said slurry being maintained at a level sufficient to prevent gelation.

* * * * *

UNITED STATES PATENT AND TRADEMARK OFFICE

CERTIFICATE OF CORRECTION

PATENT NO. : 4,216,815

DATED : August 12, 1980

INVENTOR(S) : Roy Chester Feagin

It is certified that error appears in the above—identified patent and that said Letters Patent is hereby corrected as shown below:

On the cover sheet insert:

-- (73) Assignee: Remet Corporation, New York, N. Y. --.

Signed and Sealed this

*Twenty-third* Day of *December 1980*

[SEAL]

*Attest:*

SIDNEY A. DIAMOND

*Attesting Officer*

*Commissioner of Patents and Trademarks*